US006378662B1

(12) United States Patent
Yamada

(10) Patent No.: US 6,378,662 B1
(45) Date of Patent: Apr. 30, 2002

(54) ELEVATOR GROUP SUPERVISORY SYSTEM INCLUDING A HUB CONTROLLING COMMUNICATING WITH THE SYSTEM

(75) Inventor: Takuya Yamada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/707,896

(22) Filed: Nov. 8, 2000

(30) Foreign Application Priority Data

Jun. 20, 2000 (JP) ..... 2000-184790

(51) Int. Cl.[7] ..... B66B 1/18
(52) U.S. Cl. ..... 187/382; 187/247
(58) Field of Search ..... 187/380, 382, 187/386, 388, 247, 248, 391

(56) References Cited

U.S. PATENT DOCUMENTS

| | | | | | |
|---|---|---|---|---|---|
| 4,567,560 | A | * | 1/1986 | Polis et al. | 364/184 |
| 4,771,865 | A | * | 9/1988 | Hinderling | 187/130 |
| 4,860,207 | A | * | 8/1989 | Kubo | 187/124 |
| 5,142,107 | A | * | 8/1992 | Yasuhiro | 187/127 |
| 5,387,769 | A | * | 2/1995 | Kupersmith et al. | 187/248 |
| 5,936,211 | A | * | 8/1999 | Kim | 187/248 |

FOREIGN PATENT DOCUMENTS

| | | |
|---|---|---|
| JP | 4-55272 | 2/1992 |
| JP | 7-247071 | 9/1995 |
| JP | 10-129947 | 5/1998 |
| JP | 10-182023 | 7/1998 |

* cited by examiner

*Primary Examiner*—Jonathan Salata
(74) *Attorney, Agent, or Firm*—Leydig, Voit, & Mayer, Ltd.

(57) ABSTRACT

An elevator group supervisory system for minimizing decrease of the service quality of an entire elevator system in which input/output information exchanged with hall devices is shared by a group supervisory control apparatus a respective unit control apparatus. The elevator group supervisory system includes a group supervisory control apparatus for supervisory control of respective groups of elevators; respective unit control apparatus for controlling each group of elevators respectively; and a hub with a built-in input/output apparatus section for transmitting information to and receiving information from hall devices by connecting the group supervisory control apparatus and the respective unit control apparatus with a bus communication line, has information exchanged with the hall devices shared by the group supervisory control apparatus and the respective unit control apparatus, transmits information received from the hall devices to the group supervisory control apparatus if the group supervisory control apparatus is operating normally, and transmits information received from the hall devices to the respective unit control apparatus if the group supervisory control apparatus is operating abnormally.

2 Claims, 4 Drawing Sheets

ELEVATOR GROUP SUPERVISORY SYSTEM INCLUDING A HUB CONTROLLING COMMUNICATING WITH THE SYSTEM

BACKGROUND OF THE INVENTION

1. Field of the Invention

The present invention relates to an elevator group supervisory system including a plurality of respective unit control apparatus for controlling each group of elevators, and a group supervisory control apparatus for controlling an elevator group, and particularly to the control of input/output information in a plurality of respective unit control apparatus and a group supervisory control apparatus.

2. Description of the Related Art

FIG. 4 is a view schematically illustrating the configuration of a conventional elevator group supervisory system disclosed, for example, in the Japanese Patent Application Laid-open No. Hei 04-055272.

In FIG. 4, reference numeral 2 denotes a group supervisory control apparatus for supervisory to control of a plurality of elevators, reference numeral 3 collectively referring to 3*a* and 3*b*, denotes respective unit control apparatus, reference numeral 4 denotes hall devices such as call buttons installed in a hall, reference numeral 10 denotes star configured communication lines connecting the group supervisory control apparatus 2 and the plurality of respective unit control apparatus 3 respectively, reference numeral 11 denotes a switching apparatus for switching a destination of connection of a second transmission line 14 based on a switching signal from the group supervisory control apparatus 2, reference numeral 12 denotes a switching signal transmitted to the switching apparatus 11 from the group supervisory control apparatus 2, reference numeral 13 denotes a first transmission line connecting the switching apparatus 11 and the respective unit control apparatus 3, reference numeral 14 denotes a second transmission line connecting the switching apparatus 11 and the hall devices 4, and reference numeral 15 denotes a third transmission line connecting the switching apparatus 11 and the group supervisory control apparatus 2.

Operation will now be described.

Operation of a case in which a conventional elevator group supervisory system is operating normally, will first be described.

The group supervisory control apparatus 2 turns off the switching signal 12 if the respective units control apparatus 3a is operating normally. If the switching signal 12 is off, the switching apparatus 11 connects the first transmission line 13 and the second transmission line 14. Information transmitted by hall devices from the hall devices 4, such as call buttons and outputted from the hall device 4*a* is transmitted to the respective unit control apparatus 3*a* via the second transmission line 14, the switching apparatus 11 and the first transmission line 13. The respective unit control apparatus 3*a* having received the information transmitted by hall devices transmits the information to the group supervisory control apparatus 2 via the star configured communication lines 10.

The group supervisory control apparatus 2 having received the information transmitted by hall devices transmits a respective unit control instruction to an arbitrary one of respective unit control apparatuses 3 via the star configured communication lines 10. The respective unit control apparatus 3*a* controls in response to the received respective units control instruction. The group supervisory control apparatus 2 transmits information received by hall devices (control information to the hall devices 4) to be received by the hall devices 4 such as button lights to the respective unit control apparatus 3*a* via the star configured communication lines 10, and the respective unit control apparatus 3*a* transmits the received information received by hall devices to the hall device 4*a* via the first transmission line 13, the switching apparatus 11 and the second transmission line 14.

Operation of a case in which the group supervisory control apparatus 2 stops, will now be described.

If the group supervisory control apparatus 2 is stopped, the switching signal 12 is not outputted and is turned off. If the switching signal 12 is off, the switching apparatus 11 connects the first transmission line 13 and the second transmission line 14.

Therefore, the information transmitted by hall devices outputted from the hall device 4*a* is transmitted to the respective unit control apparatus 3*a* via the second transmission line 14, the switching apparatus 11 and the first transmission line 13 in the same manner as in the normal time. The respective unit control apparatus 3*a* controls the respective unit in response to the information transmitted by hall devices because the respective unit control instruction is not sent to the respective unit control apparatus 3*a* from the group supervisory control apparatus 2. At the same time, the respective unit control apparatus 3*a* transmits the information received by hall devices such as button lights to the hall device 4*a* via the first transmission line 13, the switching apparatus 11 and the second transmission line 14.

Operation of a case in which an arbitrary respective unit control apparatus 3*a* stops, will now be described.

If the respective unit control apparatus 3*a* is stopped, the group supervisory control apparatus 2 turns on the switching signal 12. If the switching signal is on, the switching apparatus 11 connects the third transmission line 15 and the second transmission line 14. The information transmitted by hall devices such as a call button outputted from the hall device 4*a* is transmitted to the group supervisory control device 2 via the second transmission line 14, the switching apparatus 11 and the third transmission line 15. The group supervisory control apparatus 2 having received the information transmitted by hall devices transmits a respective unit control instruction to an arbitrary respective unit control apparatus 3*b* other than the respective unit control apparatus 3*a* that is stopped via the star configured communication lines 10. The respective unit control apparatus 3*b* controls in response to the received respective unit control instruction. At the same time, the group supervisory control apparatus 2 transmits the information received by hall devices such as button lights to the hall device 4*a* via the third transmission line 15, the switching apparatus 11 and the second transmission line 14.

Since the conventional elevator group supervisory system is configured as described above, if the group supervisory control apparatus 2 that controls the elevator group stops, only the respective unit control apparatus 3*a* can respond to the hall devices 4, and the service quality of the entire elevator group supervisory system decreases.

In addition, since there is provided the switching apparatus 11 for switching the destination of connection with respect to the hall devices 4 from the respective unit control apparatus 3*a* to the group supervisory control apparatus 2, so that the group supervisory control apparatus 2 can respond to the hall devices 4 even if the respective unit control apparatus 3*a* stops, increase of costs arises. This is not limited to the hall devices 4, but similar problems are observed in the connection with extension devices and external devices outside the elevator group supervisory system.

Moreover, the connection of a transmission line in place of the star configured communication lines 10 is required in order to cope with increasing volume of communication between the group supervisory control apparatus 2 and the respective unit of control apparatus 3 due to advanced functionality of the elevator group supervisory system and in order to realize reduction of costs.

SUMMARY OF THE INVENTION

The present invention has been devised in view of the above and other drawbacks, and it is an object of the present invention to provide an elevator group supervisory system with which a group supervisory control apparatus and all respective unit control apparatuses can share input/output information exchanged with hall devices (or extension devices and external devices), and thereby a plurality of respective unit control apparatuses can respond to the hall devices (or extension devices or external devices) even if a group supervisory control device stops, and which can minimize the decrease of the service quality of the entire system.

An elevator group supervisory system of the present invention comprises a group supervisory control apparatus for supervising to control a plurality of elevators, a plurality of respective unit control apparatuses for controlling each number machine of elevators respectively, and a hub with a built-in input/output apparatus section for transmitting and receiving information with hall devices to connect the group supervisory control apparatus and the plurality of respective unit control apparatuses by a bus type communication line, wherein the information exchanged between the hall devices are shared by the group supervisory control apparatus and the plurality of respective unit control apparatuses.

In addition, the input/output apparatus section is provided with controlling means for transmitting the information received from the hall devices to the group supervisory control apparatus if the group supervisory control apparatus is normal, and for transmitting the information received from the hall devices to the plurality of respective unit control apparatuses if the group supervisory control apparatus is abnormal.

Moreover, the hall devices are connected to the input/output apparatus section via serial communication lines and, at the same time, the extension devices and the external devices of the hall are connected to the input/output apparatus section via communication lines, the information of the extension devices and the external devices are also shared by the group supervisory control apparatus and the plurality of respective unit control apparatuses.

DETAILED DESCRIPTION OF THE PREFERRED EMBODIMENTS

Figure 1:
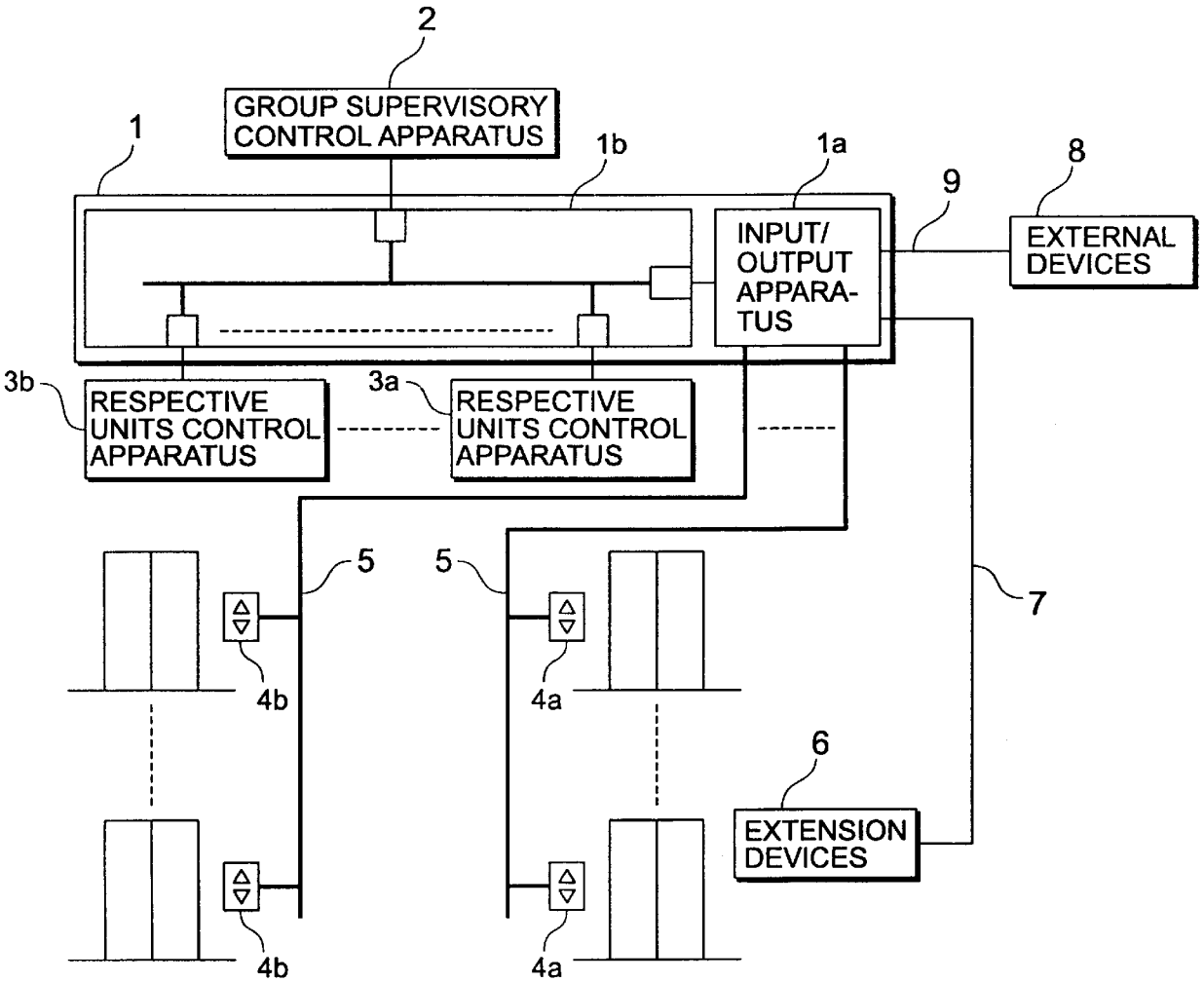
FIG. 1 is a block diagram illustrating the configuration of an elevator group supervisory system in accordance with an embodiment of the present invention.

FIG. 1 is a block diagram illustrating the configuration of an elevator group supervisory system in accordance with an embodiment of the present invention.

In FIG. 1, reference numeral 1 denotes a hub with a built-in input/output apparatus provided between a group supervisory apparatus 2 for supervising to control a group of a plurality of elevators and respective unit control apparatuses 3 (collective reference of 3*a* and 3*b*) for controlling each number machine of elevators, having an input/output apparatus section 1*a* and a hub section 1*b*. Reference numeral 4 (collective reference of 4*a* and 4*b*) denotes hall devices such as call buttons installed in a hall, reference numeral 5 denotes hall serial communication lines for connecting the hall devices 4 and the input/output-apparatus section 1*a*, reference numeral 6 denotes extension devices connected in parallel to the input/output apparatus section 1*a* and not connected to the hall serial communication lines 5, reference numeral 7 denotes a parallel communication line for connecting the extension devices 6 and the input/output apparatus section 1*a*, reference numeral 8 denotes external devices outside the elevator group, for example, a building supervisory system, and reference numeral 9 is a parallel or serial communication line for connecting the external devices 8 and the input/output apparatus section 1*a*.

The configuration shown in FIG. 1 provides a connection method with the hall devices 4, the extension devices 6 and the external devices 8, the method which is the most suitable in the case where a bus type transmission line used in a LAN and the like, particularly the EtherNET (10BASE-T) is employed, and enables the group supervisory control apparatus 2 and all the respective unit control apparatuses 3 to share input/output information of the hall devices 4, the extension devices 6 and the external devices 8 by providing the input/output apparatus section 1*a* for connecting the hall devices 4, the extension devices 6 and the external devices 8 inside the hub 1 of the EtherNET (10BASE-T). With this configuration, even if the group supervisory control apparatus 2 stops, since the plurality of respective unit control apparatuses 3 can respond to the hall devices 4, the extension devices 6 and the external devices 8, decrease of the service quality of the entire elevator group supervisory system can be minimized.

Operation in accordance with the above-mentioned configuration will now be described.

Operation of a case, in which the entire elevator group supervisory system operates normally, will first be described.

Information transmitted by hall devices such as call buttons outputted from the hall devices 4 is transmitted to the input/output apparatus section 1*a* via the hall serial communication lines 5. The input/output apparatus section 1*a* transmits the received information transmitted by hall devices to the group supervisory control apparatus 2 via hub section 1*b*. The group supervisory control apparatus 2 having received the information transmitted by hall devices transmits a respective unit control instruction to an arbitrary one of the respective unit control apparatuses 3 via the hub section 1*b*. The respective unit control apparatuses 3 renders control in response to the respective unit control instruction. At the same time, the group supervisory control apparatus 2 transmits information received by hall devices (control information for the hall devices 4) to be received by the hall devices 4 such as button lights to the input/output apparatus section 1*a* via the hub section 1*b*. The input/output apparatus section 1*a* transmits the received information received by hall devices to the hall devices 4 via the hall serial communication lines 5. Information of the extension devices 6 is also transmitted to and received by the group supervisory control apparatus 2 via the parallel communication line 7, the input/output apparatus section 1*a* and the hub section 1*b*. Information of the external devices 8 is also transmitted to and received by the group supervisory control apparatus 2 via the external communication line 9, the input/output apparatus section 1*a* and the hub section 1*b*.

In addition, operation of a case in which the group supervisory control apparatus 2 stops, will now be described.

Information transmitted by hall devices such as call buttons outputted from the hall devices 4 is transmitted to the input/output apparatus section 1*a* via the hall serial communication lines 5. The input/output apparatus section 1*a* transmits the received information transmitted by hall devices to all the respective unit control apparatuses 3 via the hub section 1*b*. The respective unit control apparatuses 3 judge and determine operation to be taken respectively with a method of deciding in advance which respective unit control apparatus 3 handles operation in each of the floors on which the hall devices 4, the extension hall devices 6 and the external devices 8 are installed. Information received by hall devices such as button lights outputted from the respective unit control apparatuses 3 is transmitted to the input/output apparatus section 1*a* via the hub section 1*b*. The input/output section 1*a* transmits the received information received by hall devices to the hall devices 4 via the hall serial communication lines 5. Information of the extension devices 6 is also transmitted to and received by all the respective unit control apparatuses 3 via the parallel communication line 7, the input/output apparatus section 1*a* and the hub section 1*b*. Information of the external devices 8 is also transmitted to and received by all the respective unit control apparatuses 3 via the external communication line 9, the input/output apparatus section 1*a* and the hub section 1*b*.

Moreover, operation of a case in which an arbitrary respective unit control apparatus 3*a* stops, will now be described.

Information transmitted by hall devices such as call buttons outputted from the hall devices 4 is transmitted to the input/output apparatus section 1*a* via the hall serial communication lines 5. The input/output apparatus section 1*a* transmits the received information transmitted by hall devices to the group supervisory control apparatus 2 via the hub section 1*b*. The group supervisory control apparatus 2 having received the information transmitted by hall devices transmits a respective unit control instruction to an arbitrary respective unit control apparatus 3*b* other than the stopped respective unit control apparatus 3*a* via the hub section 1*b*. The respective unit control apparatus 3*b* renders a control in response to the received respective unit control instruction. At the same time, the group supervisory control apparatus 2 transmits information received by hall devices such as button lights to the input/output apparatus section 1*a* via the hub section 1*b*. The input/output apparatus section 1*a* transmits the received information received by hall devices to the hall devices 4 via the hall serial communication line 5. Information of the extension devices 6 is also transmitted to and received by the group supervisory control apparatus 2 via the parallel communication line 7, the input/output apparatus section 1*a* and the hub section 1*b*. Information of the external devices 8 is also transmitted to and received by the group supervisory control apparatus 2 via the external communication line 9, the input/output apparatus section 1*a* and the hub section 1*b*.

The internal configuration of the input/output apparatus section 1*a* will now be described with an example.

Figure 2:
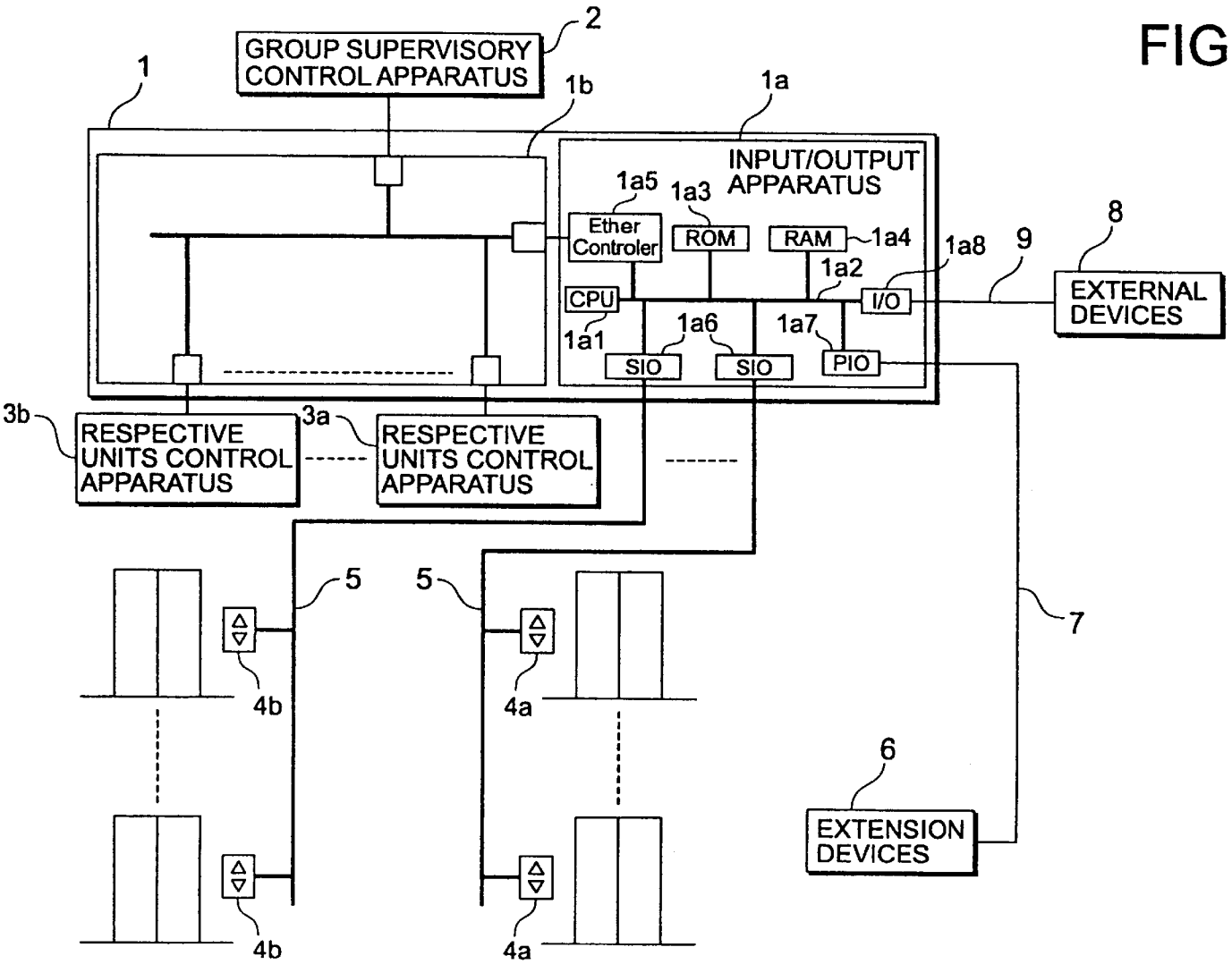
FIG. 2 is a block diagram illustrating in detail the configuration inside an input/output apparatus section shown in FIG. 1 in particular.

FIG. 2 is a block diagram illustrating in detail the internal configuration of the input/output apparatus section 1*a*.

In FIG. 2, reference numeral 1*a*1 denotes a CPU as controlling means, reference numeral 1*a*3 denotes a ROM for storing a control program of the CPU 1*a*1, reference numeral 1*a*4 denotes a RAM for storing communication data and various kinds of calculation results in executing the program by the CPU 1*a*1, reference numeral 1*a*5 denotes an EtherNET controller to be connected to a hub section 1*b*, 1*a*6 denotes a serial input/output section (represented as SIO in the figure) to be connected to hall serial communication lines 5 for performing transmission and reception of data with hall devices 4, reference numeral 1*a*7 denotes a parallel input/output section (represented as PIO in the figure) to be connected to extension devices 6 via a parallel communication line 7, reference numeral 1*a*8 denotes a serial or parallel input/output section (represented as I/O in the figure) to be connected with external devices 8 via external communication line 9, and reference numeral 1*a*2 denotes an address data bus for connecting the CPU 1*a*1, the ROM 1*a*3, the RAM 1*a*4, the EtherNET controller 1*a*5, the serial input/output apparatus section 1*a*6 and the parallel input/output apparatus section 1*a*7.

Figure 3:
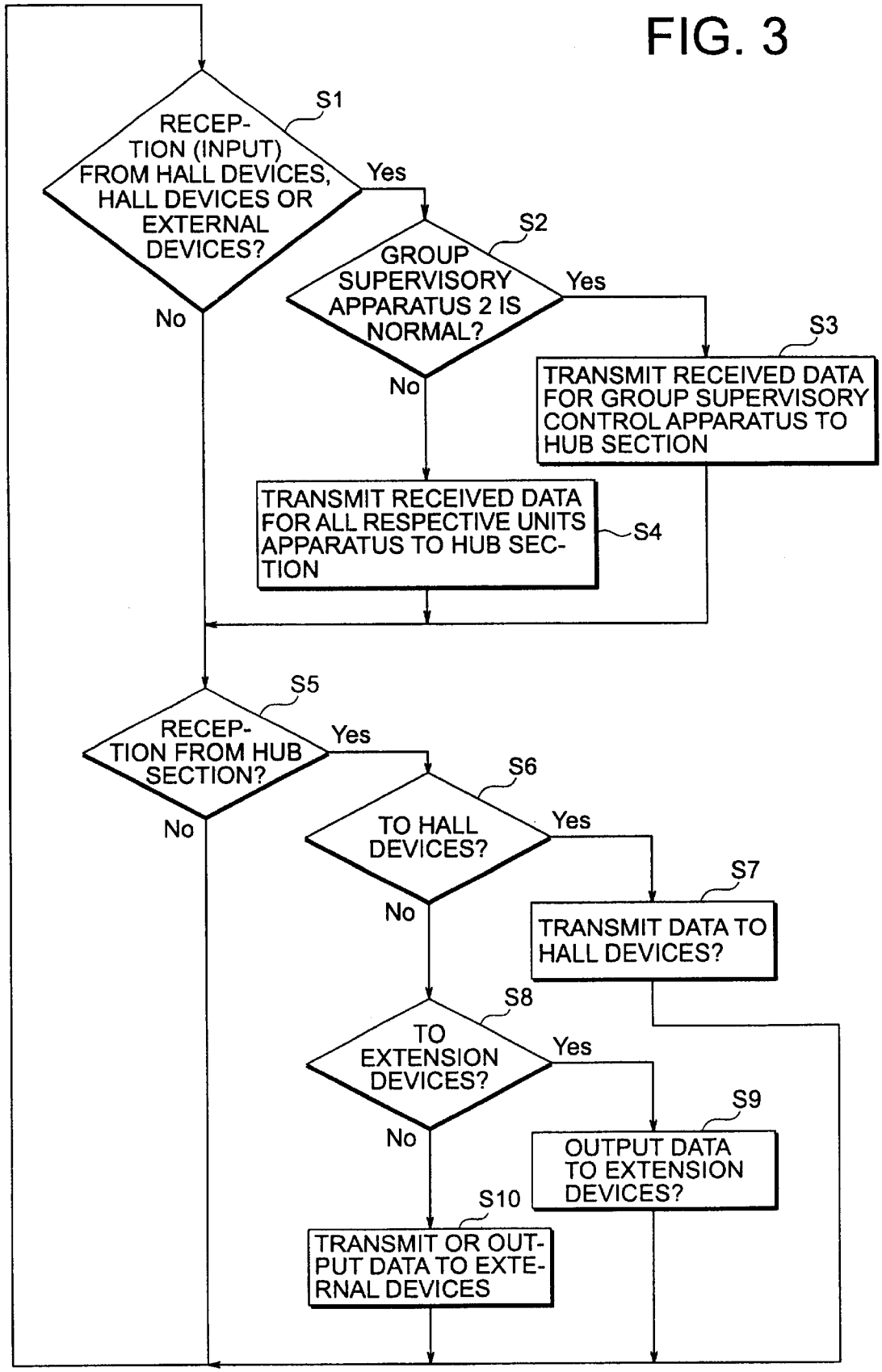
FIG. 3 is a flow chart describing the contents of control by a CPU inside the input/output apparatus section shown in FIG. 2.
Figure 4:
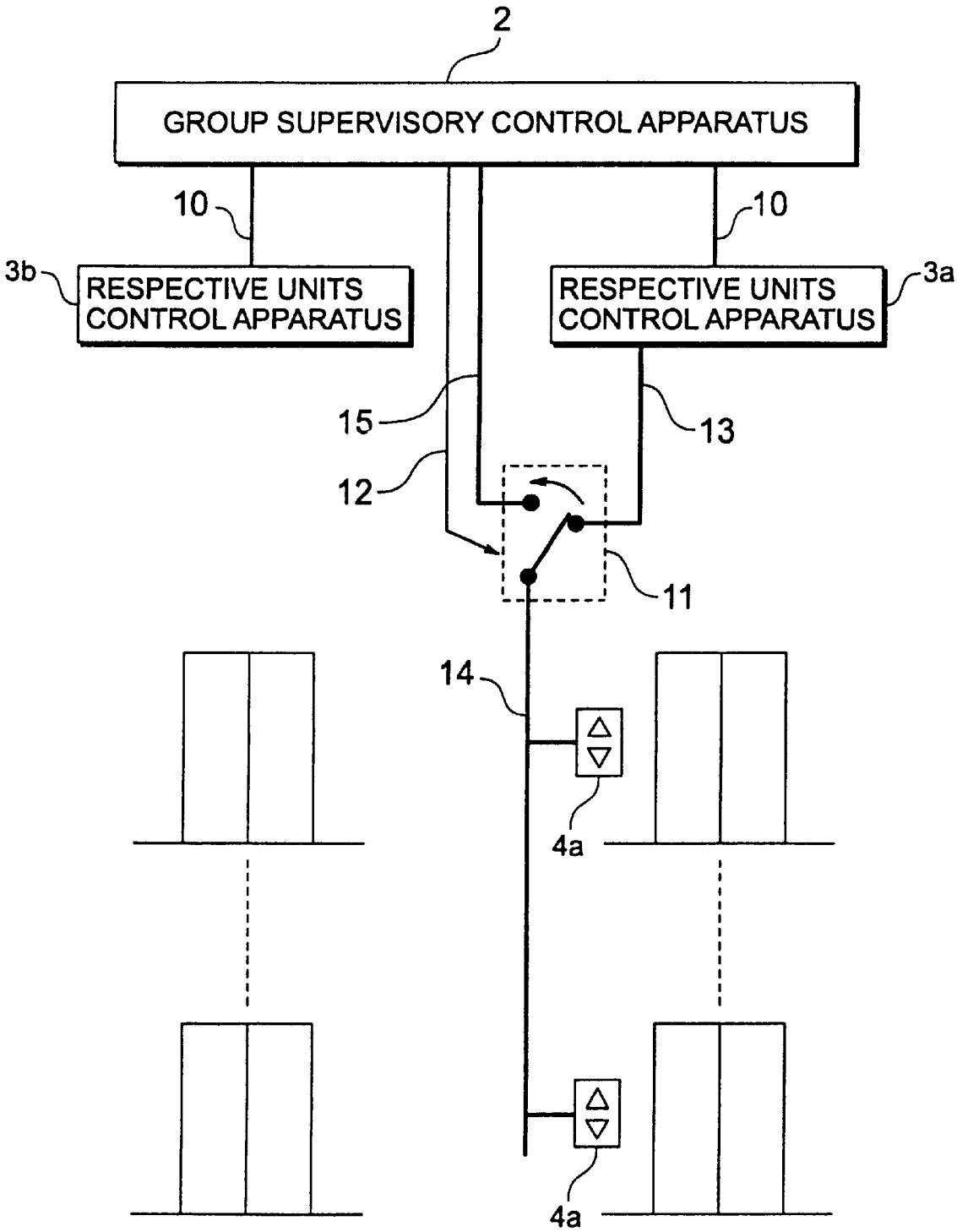
FIG. 4 is a block diagram illustrating the configuration of the conventional elevator group supervisory system.

Operation of the input/output apparatus section 1*a* will now be described with reference to the flow chart shown in FIG. 3 that describes contents of the control by the CPU 1*a*1.

The CPU 1*a*1 confirms if there are reception of data in the serial input/output section 1*a*6 from the hall devices 4, input of data in the parallel input/output section 1*a*7 from the extension devices 6, and input or reception of data in the input/output section 1*a*8 from the external devices 8 (step S1). In case that there is reception or input of data, if the group supervisory control apparatus 2 is normal (step S2), the CPU 1*a*1 transmits the received or inputted data from the EtherNET controller 1*a*5 to the hub section 1*b* with the group supervisory control apparatus 2 as a destination of transmission (step S3). On the other hand, if the group supervisory control apparatus 2 is abnormal (step S2), the CPU 1*a*1 transmits the received or inputted data from the EtherNET controller 1*a*5 to the hub 1*b*with an arbitrary one of the respective unit control apparatuses 3 as a destination of transmission (step S4).

In addition, the CPU 1*a*1 confirms if there is reception of data in the EtherNET controller 1*a*5 (step S5). In case that there is reception in the EtherNET controller 1*a*5, if the received data is one for the hall devices 4 (step S6), the CPU 1*a*1 transmits the data from the serial input/output section 1*a*6 to the hall devices 4 (step S7). If the received data is one for the extension devices 6 (step S8), the CPU; 1*a*l outputs the data from the parallel input/output section 1*a*7 to the extension devices 6 (step S9). If the received data is one for the external devices 8, the CPU 1*a*1 outputs or transmits the data from the input/output section 1*a*8 to the external devices 8 (step S10).

As described above, in accordance with the present invention, since the group supervisory control apparatus and the plurality of respective unit control apparatuses are connected by the bus type communication lines, the hub with the built-in input/output apparatus section for transmitting and receiving information with the hall devices is provided, and the information exchanged with the hall devices is shared by the group supervisory control apparatus and the plurality of respective unit control apparatus, even if the group supervisory control apparatus stops, the plurality of respective unit control apparatuses can respond to the hall devices and decrease of the service quality of the entire system can be minimized.

In addition, since there is provided the control means for transmitting information received from the hall devices to the group supervisory control apparatus if the group supervisory control apparatus is normal and for transmitting information received from the hall devices to the plurality of respective unit control apparatuses if the group supervisory control apparatus is abnormal, even if the group supervisory control apparatus stops, the plurality of respective unit control apparatuses can respond to the hall devices without fail and decrease of the service quality of the entire system can be minimized.

Moreover, since the hall devices are connected to the input/output apparatus section via the serial communication line and, at the same time, the extension devices and the external devices of the hall are connected via the communication line, and information of the extension devices and the external devices is also shared by the group supervisory control apparatus and the plurality of respective unit control apparatuses, all the respective unit control apparatuses can transmit and receive information to and from the hall devices, the extension devices and the external devices even if the group supervisory control apparatus stops, and decrease of the service quality of the entire elevator group supervisory system can be minimized with the method of deciding in advance which respective unit control apparatus handles operation in each of the floors on which the hall devices the extension hall devices and the external devices are installed.

Thus, it is seen that an elevator group supervisory system is provided. One skilled in the art will appreciate that the present invention can be practiced by other than the preferred embodiments which are presented for the purposes of illustration and not of limitation, and the present invention is limited only by the claims which follow:

What is claimed is:

1. An elevator group supervisory system comprising:

a group supervisory control apparatus for supervisory control of groups of elevators, each group including plurality of elevators;

a plurality of respective unit control apparatus for controlling each group of elevators, respectively; and a hub including an input/output apparatus section for transmitting information to and receiving information from hall devices by connecting said group supervisory control apparatus and said plurality of respective unit control apparatus with a communication bus, whereby information exchanged with said hall devices is shared by said group supervisory control apparatus and the respective unit control apparatus, wherein said input/output apparatus section includes controlling means for transmitting information received from said hall devices to said group supervising control apparatus if said group supervisory control apparatus is operating normally, and for transmitting information, received from said hall devices, to said plurality of respective unit control apparatus if said group supervisory control apparatus is operating abnormally.

2. The elevator group supervisory system according to claim 1, wherein said hall devices are connected to said input/output apparatus section via a serial communication line and extension devices and external devices of a hall are connected to said input/output apparatus section via a communication line, and information exchanged with said extension devices and said external devices is shared by said group supervisory control apparatus and said plurality of respective unit control apparatus.

* * * * *